US007231928B2

(12) United States Patent
Dingler et al.

(10) Patent No.: US 7,231,928 B2
(45) Date of Patent: Jun. 19, 2007

(54) HOUSEHOLD DISHWASHER WITH BULK WASH AID DISPENSER

(75) Inventors: Geoffrey L. Dingler, St. Joseph, MI (US); Brent A. DeWeerd, St. Joseph, MI (US); Christopher J. Carlson, Watervliet, MI (US); Michael L. Huie, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 393 days.

(21) Appl. No.: 10/442,039

(22) Filed: May 20, 2003

(65) Prior Publication Data

US 2004/0231710 A1 Nov. 25, 2004

(51) Int. Cl.
*B08B 3/00* (2006.01)

(52) U.S. Cl. ..... 134/93; 134/56 D

(58) Field of Classification Search ..... 134/56 D, 134/57 D, 58 D, 93, 60; 222/630, 637, 651, 222/652; 422/261, 266, 110
See application file for complete search history.

(56) References Cited

U.S. PATENT DOCUMENTS 2,127,778 A * 8/1938 Lewis ..... 134/93
2,226,096 A * 12/1940 Halsey ..... 134/56 D
3,130,738 A * 4/1964 Kays et al. ..... 222/651
4,020,865 A * 5/1977 Moffat et al. ..... 137/268
4,426,362 A 1/1984 Copeland et al. ..... 422/263
4,753,781 A * 6/1988 Cassady et al. ..... 422/264
4,763,676 A * 8/1988 Mizuno ..... 134/100.1
4,790,981 A * 12/1988 Mayer et al. ..... 422/263
RE32,818 E * 1/1989 Fernholz et al. ..... 510/225
4,808,236 A 2/1989 Davis, Jr. ..... 134/25
4,938,240 A * 7/1990 Lakhan et al. ..... 134/93
5,007,559 A * 4/1991 Young ..... 222/1
5,176,297 A * 1/1993 Mooney et al. ..... 222/325
5,186,912 A * 2/1993 Steindorf et al. ..... 422/263
5,205,304 A 4/1993 Cooper et al. ..... 134/99.2
5,268,153 A * 12/1993 Muller ..... 422/263
5,417,939 A * 5/1995 Bunschoten et al. ..... 422/264
5,427,748 A * 6/1995 Wiedrich et al. ..... 422/284
5,501,742 A 3/1996 Fernholz ..... 134/25.2
5,707,590 A * 1/1998 Thomas et al. ..... 422/119
5,849,253 A * 12/1998 Crossdale et al. ..... 422/264
6,007,788 A * 12/1999 Bellon et al. ..... 422/264
6,622,896 B2 * 9/2003 Hegeman et al. ..... 222/651
6,701,944 B2 * 3/2004 McNabb et al. ..... 134/93
6,855,300 B2 * 2/2005 Cormier ..... 422/265

* cited by examiner

*Primary Examiner*—Michael Barr
(74) *Attorney, Agent, or Firm*—John Morrison; John F. Colligan

(57) ABSTRACT

A household dishwasher with a bulk wash aid dispenser for metering individual charges of wash aid from a bulk wash aid supply.

24 Claims, 4 Drawing Sheets

HOUSEHOLD DISHWASHER WITH BULK WASH AID DISPENSER

BACKGROUND OF THE INVENTION

1. Field of the Invention

The invention relates generally to a household dishwashing machine with a wash aid dispenser and more particularly to a household dishwashing machine with a wash aid dispenser for dispensing a charge of wash aid from a bulk wash aid supply.

1. Description of the Related Art

Food processing, preparation, serving, and consumption commonly employ reusable tableware, pots and pans, utensils, and other equipment. Before soiled items can be used, they are commonly cleaned in a dishwashing machine. Current household dishwashers utilize a single or individual charge of wash aids, such as detergents, rinse aids, and film removers. As a result, the user must provide new individual charges of the appropriate wash aids with each use of the dishwasher. This procedure is inconvenient for the user who must remember to supply the wash aids and spend time refilling the appropriate dispensers. Furthermore, the amount of wash aid introduced into the dispensers is dependent on the user. Although the dispenser can have fill level indicators, users can ignore the recommendations and either use too much or too little wash aid. Improper quantities of wash aid can cause deposition of residue and films or inadequate cleansing of the dishes, utensils, and glasses.

The problems associated with single-use wash aids in dishwashers are remedied by bulk wash aids. In general, a bulk wash aid is an agglomeration of multiple charges of a wash aid for use in multiple dishwashing cycles. When this form of wash aid is employed, the user does not have to replace it between each use of the dishwasher nor determine the quantity of wash aid in the dishwasher liquid solution. Rather, the amount of wash aid supplied to the solution is metered by a bulk wash aid dispenser.

Prior household dishwashers with bulk wash aid dispensers have the disadvantage of the having the bulk wash aid supply continuously exposed to the recirculating liquid in the dishwasher. Because the bulk wash aid is constantly in fluid communication with the liquid, it is difficult to properly meter an accurate charge of detergent. Additionally, dishwashers can utilize a rinse cycle wherein no wash aid is desired, but dishwashers with dispensers described above are not able to cease the release of wash aid into the rinse liquid.

Therefore, there is a need for a household dishwasher with a bulk dispenser wherein an individual charge of wash aid can be metered from the bulk supply of wash aid. The need for such a bulk dispenser is especially important for non-liquid wash aids, such as powders and solids. The storing and metering of non-liquid wash aids is inherently more difficult than for liquid wash aids.

SUMMARY OF THE INVENTION

The invention disclosed herein addresses the problems of the prior art and comprises a household dishwasher with a bulk wash aid dispenser that can accurately dispense an individual charge of wash aid when desired rather than continuously dispensing the wash aid during all dishwasher cycles involving the spraying of liquid.

The invention relates to a household dishwasher comprising a housing defining an interior chamber and having an open face providing access to the interior chamber. A door is moveably mounted to the housing for movement between a closed position where the door closes the open face to block access to the interior chamber and an open position where the door is remote from the open face to permit access to the interior chamber. A tub is located within the interior chamber and comprises spaced side walls, a top wall connecting upper edges of the spaced side walls, a bottom wall connecting lower edges of the spaced side walls, and a rear wall connecting rear edges of the spaced side walls to form an open-face wash chamber with an open face that is coincident with the open face of the interior chamber. A liquid recirculation system is positioned in the tub for recirculating liquid throughout the wash chamber. A bulk wash aid dispenser is located within the wash chamber and comprises a wash aid meter that dispenses an individual charge of wash aid from a bulk wash aid supply and a cover sized to overlie and receive the bulk wash aid supply to prevent the recirculated liquid from directly contacting the bulk wash aid supply. communication with the liquid, it is difficult to properly meter an accurate charge of detergent. Additionally, dishwashers can utilize a rinse cycle wherein no wash aid is desired, but dishwashers with dispensers described above are not able to cease the release of wash aid into the rinse liquid.

Therefore, there is a need for a household dishwasher with a bulk dispenser wherein an individual charge of wash aid can be metered from the bulk supply of wash aid. The need for such a bulk dispenser is especially important for non-liquid wash aids, such as powders and solids. The storing and metering of non-liquid wash aids is inherently more difficult than for liquid wash aids.

SUMMARY OF THE INVENTION

The invention disclosed herein addresses the problems of the prior art and comprises a household dishwasher with a bulk wash aid dispenser that can accurately dispense an individual charge of wash aid when desired rather than continuously dispensing the wash aid during all dishwasher cycles involving the spraying of liquid.

The invention relates to a household dishwasher comprising a housing defining an interior chamber and having an open face providing access to the interior chamber. A door is moveably mounted to the housing for movement between a closed position where the door closes the open face to block access to the interior chamber and an open position where the door is remote from the open face to permit access to the interior chamber. A tub is located within the interior chamber and comprises spaced side walls, a top wall connecting upper edges of the spaced side walls, a bottom wall connecting lower edges of the spaced side walls, and a rear wall connecting rear edges of the spaced side walls to form an open-face wash chamber with an open face that is coincident with the open face of the interior chamber. A liquid recirculation system is positioned in the tub for recirculating liquid throughout the wash chamber. A bulk wash aid dispenser is located within the wash chamber and comprises a wash aid meter that dispenses an individual charge of wash aid from a bulk wash aid supply and a cover sized to overlie and receive the bulk wash aid supply to prevent the recirculated liquid from directly contacting the bulk wash aid supply.

The cover of the bulk wash aid dispenser has a lower peripheral edge that defines an open bottom and extends below the bulk wash aid supply when the bulk wash aid supply is received within the cover to form an air pocket around the bulk wash aid supply to prevent liquid that accumulates in the bottom of the wash chamber from contacting the bulk wash aid supply when the level of the accumulating liquid rises above the peripheral edge.

The wash aid meter can comprise a spray nozzle that directs a spray of fluid onto the bulk wash aid supply to erode or dissolve a sufficient amount of wash aid from the bulk wash aid supply to form the individual charge of wash aid. Preferably, the spray nozzle is positioned beneath the bulk wash aid supply to direct a spray of fluid through the open bottom of the cover and onto the bulk wash aid supply. In this embodiment, the bulk wash aid dispenser further comprises a support for holding the bulk wash aid supply, and the support is carried by and can be removeably mounted to the cover.

In another embodiment, the wash aid meter can comprise a moveable support that carries the bulk wash aid supply and is moveable from a neutral position in the air pocket to an active position below the lower peripheral edge of the cover to expose the bulk wash aid supply carried by the moveable support to liquid accumulating in the bottom of the wash chamber to erode or dissolve a sufficient amount of wash aid from the bulk wash aid supply to form the individual charge of wash aid. Preferably, the moveable support comprises a cradle for carrying the bulk wash aid supply and an arm connected to the cradle and pivotally mounted to one of the cover and the bottom wall for pivotal movement between a first position where the cradle is in the neutral position and a second position where the cradle is in the active position.

The cover of the bulk wash aid dispenser can have the shape of a dome and it can be removeably mounted to the bottom wall of the tub.

In another aspect, the invention relates to a household dishwasher comprising a tub with spaced side walls, a top wall connecting upper edges of the spaced side walls, a bottom wall connecting lower edges of the spaced side walls, and a rear wall connecting rear edges of the spaced side walls to form an open-face wash chamber. A liquid recirculation system is positioned in the tub for recirculating liquid throughout the wash chamber. A bulk wash aid dispenser is mounted within the wash chamber and comprises a wash aid meter that dispenses an individual charge of wash aid from a bulk wash aid supply and a cover sized to overlie and receive the bulk wash aid supply to prevent the recirculated liquid from directly contacting the bulk wash aid supply.

The cover has a lower peripheral edge that defines an open bottom and extends below the bulk wash aid when the bulk wash aid supply is received within the cover to form an air pocket around the bulk wash aid supply to prevent liquid that accumulates in the bottom of the wash chamber from contacting the bulk wash aid supply when the level of the accumulating liquid rises above the peripheral edge. The cover can have a dome shape and can be moveably mounted to the bottom wall wherein the cover can be moved from a closed use position to an open fill position. Furthermore, the cover can be removeably mounted to the bottom wall.

The wash aid meter can comprise a spray nozzle that directs a spray of fluid onto the bulk wash aid supply to erode or dissolve a sufficient amount of wash aid from the bulk wash aid supply to form the individual charge of wash aid.

In another embodiment, the wash aid meter can comprise a moveable support for carrying the bulk wash aid supply that is moveable from a neutral position within the cover to an active position below the lower peripheral edge of the cover to expose the bulk wash aid supply carried by the moveable support to liquid accumulating in the bottom of the wash chamber to erode or dissolve a sufficient amount of wash aid from the bulk wash aid supply to form the individual charge of wash aid.

BRIEF DESCRIPTION OF THE DRAWINGS

The invention will now be described with reference to the drawings wherein.

DESCRIPTION OF THE PREFERRED EMBODIMENTS

Figure 1:
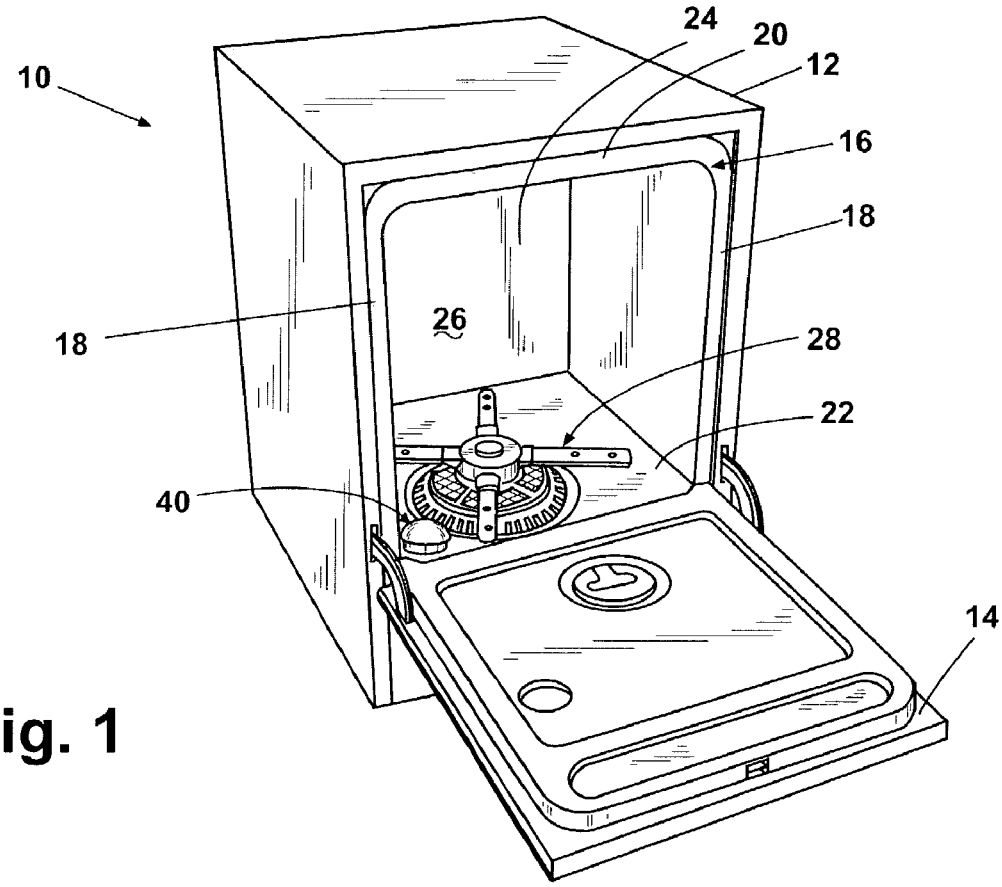
FIG. 1 is a perspective view of a household dishwasher having a wash tub in which is located a bulk wash aid dispenser according to the invention.

Referring now to the drawings, FIG. 1 illustrates a household dishwasher 10 comprising a housing 12 defining an interior chamber having an open face providing open access to the interior chamber. A door 14 is moveably mounted to the housing 12 such that the door 14 can be moved between a closed position where the door closes the open face to block access to the interior chamber and an open position (shown in FIG. 1) where the door 14 is remote from the open face to permit access to the interior chamber. Within the housing is a tub 16 with spaced side walls 18, a top wall 20 connecting upper edges of the spaced side walls 18, a bottom wall 22 connecting lower edges of the spaced side walls 18, and a rear wall 24 connecting the rear edges of the spaced side walls 18 to form an open-faced wash chamber 26. The open face of the wash chamber 26 is coincident with the open face of the interior chamber.

Figure 2:
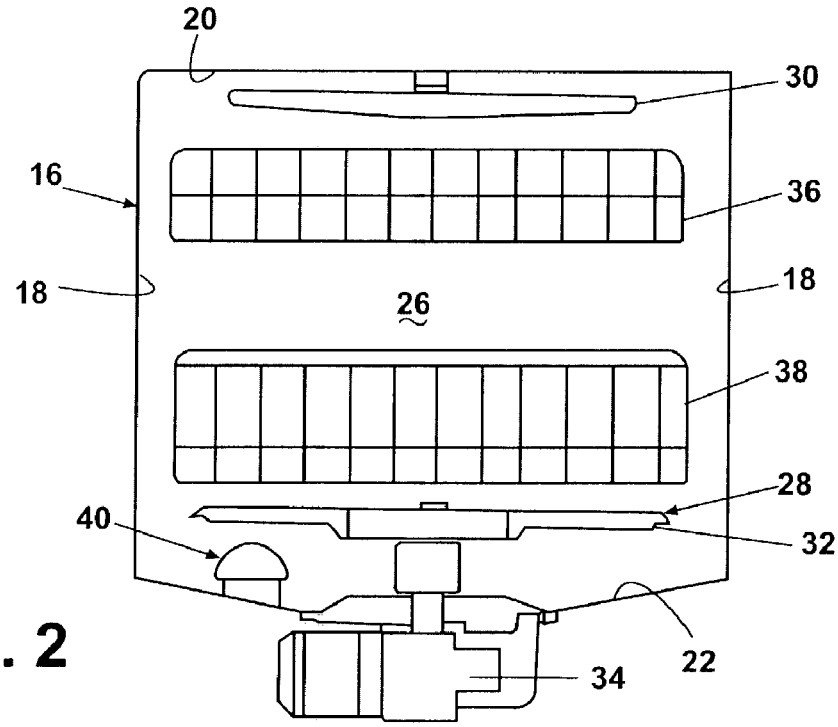
FIG. 2 is a schematic of the dishwasher of FIG. 1 and illustrating a liquid recirculation system for the dishwasher.

The household dishwasher 10 further comprises a liquid recirculation system 28, shown in FIG. 1 and 2, for introducing, recirculating, and spraying liquid throughout the wash chamber 26. The liquid recirculation system is well known and can include components such as an upper spray arm 30, a lower spray arm 32, and a pump 34. The pump 34 takes water introduced into wash chamber 26 and pumps it to the upper and lower spray arms 30, 32, which direct the water throughout the wash chamber 26, where it falls back toward the pump 34. The water is then recirculated. If a wash aid is introduced into the water, it will form a wash liquid that is recirculated. The liquid recirculation system 28 illustrated in the figures is exemplary, and other types of liquid recirculation systems with components positioned in different locations or alternative components can be utilized in conjunction with the present invention. The features of liquid recirculation systems are well known and are not germane to the invention.

Additionally, the household dishwasher 10 can have an upper basket 36 and a lower basket 38 located within the wash chamber 26 for holding utensils, glasses, tableware, pots and pans, and other related objects. It should be noted that the upper basket 36 and the lower basket 38 shown in FIG. 2 are examples, and other sizes, shapes, and quantities of baskets can be utilized.

Figure 3:
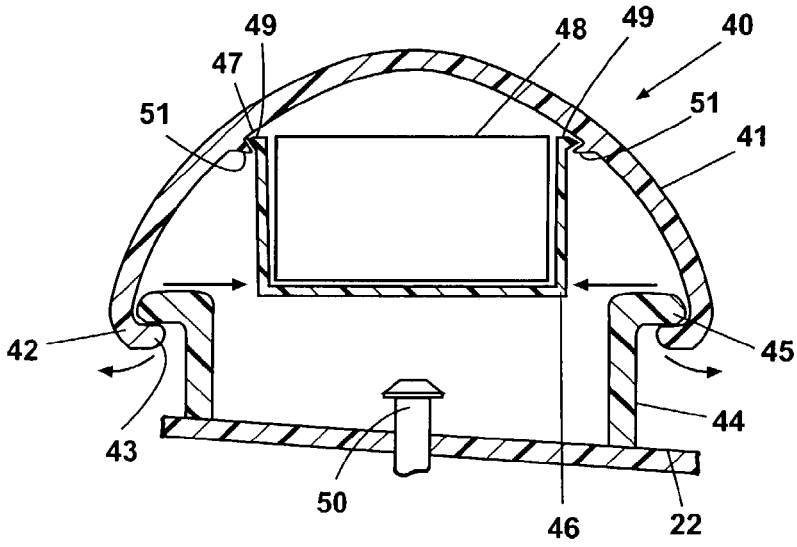
FIG. 3 is an enlarged sectional view of the bulk wash aid dispenser of FIG. 1, which includes a removeably mounted dome cover and a spray nozzle for eroding or dissolving a charge of wash aid from a bulk wash aid supply.

Referring to FIGS. 1–3, the household dishwasher 10 further comprises a bulk wash aid dispenser 40 positioned within the wash chamber 26. As best seen in FIG. 3, the bulk wash aid dispenser 40 comprises a cover 41 with a lower peripheral edge 42 and an inwardly extending shoulder 43, mounting posts 44 with an outwardly extending shoulder 45, a support 46 for holding a bulk wash aid supply 48, support mounts 47, and a spray nozzle 50 which acts as a wash aid meter.

The bulk wash aid supply 48 is an agglomeration of multiple charges of a wash aid for use in multiple dishwashing cycles and can comprise a detergent, a rinse aid, a film remover, or any other suitable substance for use in household dishwashers. For purposes of this invention, it is contemplated that the bulk wash aid supply 48 is a solid or dry wash aid, preferably in the form of a block. Liquid wash aids are known; however, the invention is not best suited for dispensing liquid wash aids. The invention is best suited for dispensing solid or dry wash aids.

The cover 41 is sized to overlie and receive the bulk wash aid supply 48. Further, the lower peripheral edge 42 of the cover 41 defines an open bottom and extends below the bulk wash aid supply 48 when the bulk wash aid supply 48 is received within the cover 41 to form an air pocket 39 around the bulk wash aid supply 48 to prevent liquid that accumulates in the bottom of the wash chamber 26 from contacting the bulk wash aid supply 48 when the level of the accumulating liquid is above the peripheral edge 42 of the cover 41. The cover 41, which preferably has the shape of a dome, further protects the bulk wash aid supply 48 by acting as a barrier to liquid that is recirculated by the upper and lower spray arms 30, 32 of the liquid recirculation system 28.

The bulk wash aid dispenser 40 is mounted to the bottom wall 22 of the tub 16 via the mounting posts 44. The cover 41 is attached to the mounting posts 44 and secured in position via interaction of the inwardly extending shoulder 43 of the cover 41 with the outwardly extending shoulder 45 of the mounting posts 44. The inwardly extending shoulder 43 and the outwardly extending shoulder 45 overlap and frictionally engage to prevent inadvertent removal of the cover 41. The mounting posts 44 and/or the cover 41 are preferably made from a material that is sufficiently resilient such that one or both of the mounting posts 44 and cover 41 can deflect to receive the other and form a snap-fit.

In a manner similar to the posts 44 and cover 41, support mounts 47 removeably mount the support 46 to the cover 41. The support mounts 47 can be any type of appropriate connector that allows the support 46 to be carried by the cover 41 and that permits movement of the support 46 relative to the cover 41. Preferably, the mounts 47 are formed as a resilient finger 49 on the support 46 that cooperates with a corresponding protrusion 51 on the cover 41, with the finger 49 being snap-fit behind the protrusion 51 when the support 46 is mounted to the cover 41.

The mounting of the support 46 to the cover 41 is preferred because it simplifies the replenishment of the bulk wash aid supply 48. When the user removes the cover 41, the user also removes the support 46 carrying the bulk wash aid supply 48. The user can then squeeze the fingers 49 to remove the support 46 from the cover 41 and replenish the bulk wash aid supply 48. Alternatively, the support 46 can be mounted to some other component of the bulk wash aid dispenser 40 or tub 16, such that it is not carried by the cover 41.

The spray nozzle 50 is positioned beneath the bulk wash aid supply 48 so that it can direct a spray of fluid through the open bottom of the cover 41 and onto the bulk wash aid supply 48. As one of skill in the art should recognize, support 46 should be designed to at least partially support wash aid supply 48 and should also be configured to allow fluid to pass through and wash over the wash aid supply 48. The spray nozzle 50 could also be mounted to the bottom wall 22 of the tub 16, as shown in FIG. 3 or elsewhere in the wash chamber 26 as long as the output from the spray nozzle 50 can reach the bulk wash aid supply 48. In another example, the spray nozzle 50 could be part of the pump 34 and extend therefrom along the upper surface of the bottom wall toward the dispenser 40.

While it is preferred that the bulk wash aid dispenser 40 is mounted to the bottom wall 22 of the wash tub 16, the dispenser can be located elsewhere in the wash tub 16. For example, the dispenser 40 could be mounted to one of the side walls 18, preferably near the junction with the bottom wall 22. In such a configuration, the supports 44 could extend laterally from the sidewalls 18, yet the cover 41 would still be oriented in the same manner as illustrated.

In operation, a user first equips the bulk wash aid dispenser 40 with the bulk wash aid supply 48 by accessing the support 46. Accessing the support 46 is accomplished by simultaneously pulling the lower peripheral edge 42 of the cover 41 outward and pushing the mounting posts 44 inward. This motion causes the inwardly extending shoulder 43 of the cover 41 and the outwardly extending shoulder 45 of the mounting posts 44 to disengage such that the cover 41 can be removed. Next, the user can completely detach the support 46 from the cover 41 or disconnect a portion of the support 46 at one of the support mounts 47 and inserts a bulk wash aid supply 48 into the support 46. Once the bulk wash aid supply 48 is in position, the support 46 is reattached to the cover 41, and the cover 41 is placed on the mounting posts 44 by pushing down on the cover 41 such that the lower peripheral edge 42 of the cover 41 contacts the mounting posts 44, resulting in the relative deflection of the peripheral edge 42 and the mounting posts 44 such that the inwardly extending shoulder 43 of the cover 41 is able to slide past the outwardly extending shoulder 45 of the mounting posts 44 and snap into frictional engagement with the outwardly extending shoulder 45.

After the bulk wash aid dispenser 40 is equipped, the user selects and initiates the desired dishwashing cycles. Throughout the dishwashing cycles, the liquid recirculation system 28 acts, when appropriate, to fill the tub 16 with a suitable quantity of liquid, pump the liquid from the bottom of the tub 16 to the upper and lower spray arms 30, 32, recirculated the liquid throughout the wash chamber 26, pump the accumulated liquid back to the upper and lower spray arms 30, 32 if required, and drain the spent liquid out of the wash chamber 26.

Figure 4:
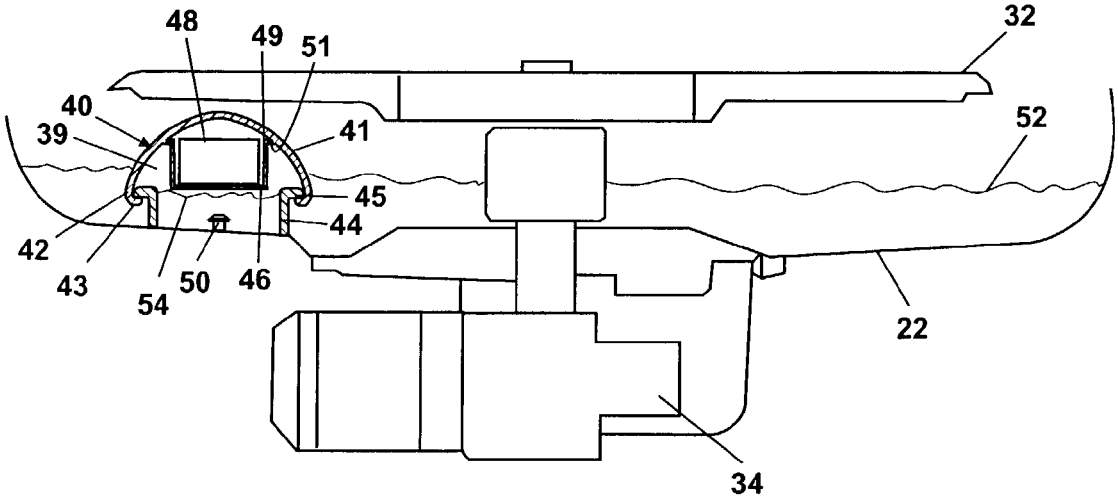
FIG. 4 is a schematic view of the lower portion of the dishwasher of the bulk wash aid dispenser of FIG. 1 illustrating the formation of a protective air pocket in the dome cover when the liquid in the tub rises above the cover.

As is best seen in FIG. 4, the bulk wash aid supply 48 is protected from the accumulated and recirculated liquid by the cover 41 and, thus, undesired erosion or dissolution of the bulk wash aid supply 48 is prevented. As the tub is filled with liquid, the liquid level 52 in the tub can rise above the bottom lip 42 of the cover 41. Liquid level 54 in the cover 41 is approximately equal to the location of the bottom lip 42 because the air pocket 39 prevents the liquid from rising within the cover 41. With this configuration, the cover 41 can simultaneously protect the bulk wash aid supply 48 from both the accumulating liquid and the sprayed liquid.

When a dishwashing cycle requires an individual charge of wash aid, spray nozzle 50 activates. The spray nozzle 50 ejects an appropriate quantity of fluid at a predetermined pressure onto the bulk wash aid supply 48 to accurately meter an individual charge of wash aid by erosion or dissolution. When activation of the spray nozzle 50 occurs, the liquid level 54 in the cover 41 must be lower than the top of the spray nozzle 50 so that the accumulating liquid does not impede ejection of the fluid from the spray nozzle 50 into the cover 41 and onto the bulk wash aid supply to erode or dissolve a charge of wash aid. As the individual charge of wash aid is dispensed, it enters the liquid recirculation system 28 through wash liquid in the dome which flows through posts 44. The dispensing process can be a single event or can occur at multiple intervals depending on the dishwashing cycle requirements.

In this embodiment, the spray nozzle 50 performs the function of a wash aid meter in that the amount of wash aid eroded or dissolved from the bulk wash aid supply 48 is controlled or metered by the duration that the spray nozzle 50 directs fluid onto the bulk wash aid supply 48. This can be accomplished by knowing the volumetric flow rate of the fluid emitted by the nozzle 50 and the erosion or dissolving rate of the bulk wash aid supply 48 when subjected to a fluid under such a flow rate. The erosion or dissolution rates can also be determined based on the life cycle of the bulk wash aid supply 48 if the erosion or dissolving rates are a function of the life cycle. Thus, the controller for the dishwasher 10 need only know the duration that the spray nozzle 50 need be turned on to meter the proper amount of wash aid to obtain a single charge from the wash aid supply 48.

After the dishwashing cycles are completed, the user can leave the bulk wash aid supply 48 in the bulk wash aid dispenser 40 for future employment until the entire bulk wash aid supply 48 is utilized. The user can determine if a new bulk aid supply 48 is required by opening the cover 41 as described above. Optionally, the cover 41 can be composed of a transparent material so that the user can visually observe the volume of the bulk wash aid supply 48 without removing the cover 41. A further option is that the controller for the dishwasher 10 can monitor the volume of water emitted from the spray nozzle 50 or the cumulative activation time for the spray nozzle 50 since the last replenishment of the bulk aid supply 48 and calculate the approximate time when the bulk wash aid supply 48 is exhausted. The control could then indicate to the user through a traditional visual or audible indicator that the bulk wash aid dispenser 40 needs replenishing.

Figure 5A:
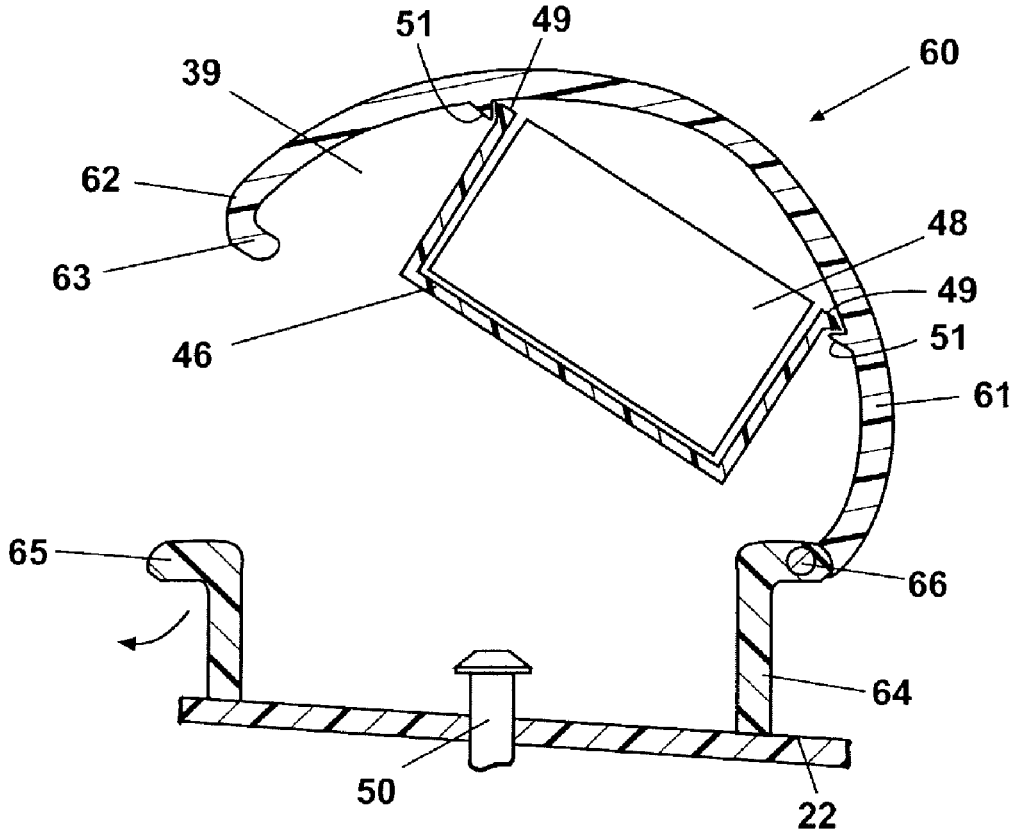
FIG. 5*a* is an enlarged sectional view of the bulk wash aid dispenser of FIG. 1, with an alternative cover that is hingedly mounted and in an open or fill position.
Figure 5B:
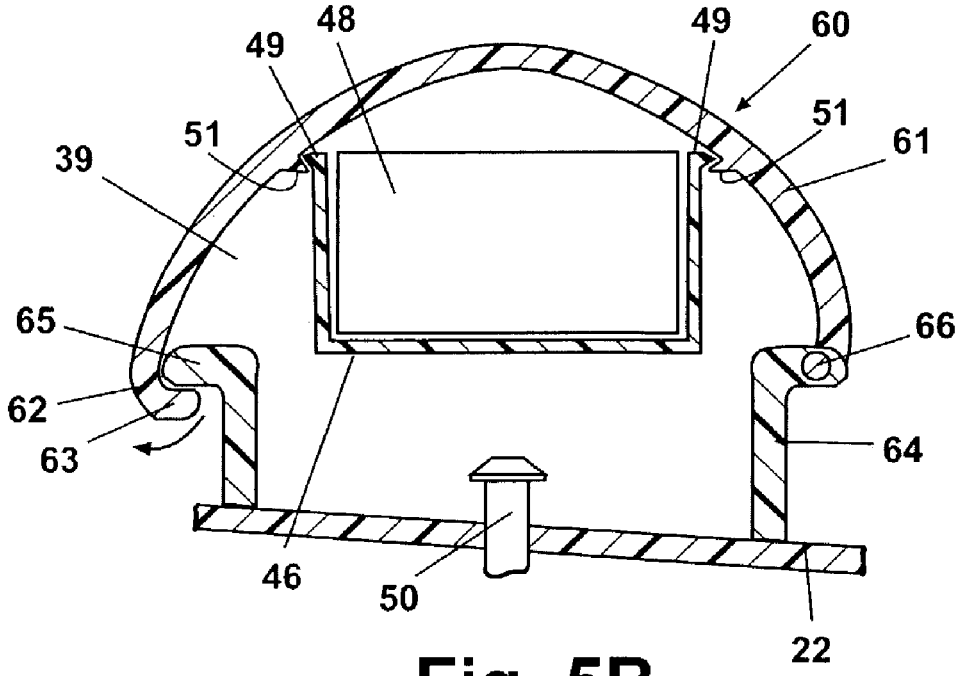
FIG. 5*b* is identical to FIG. 5*a* except that the cover is shown in a closed or use position.

An alternative bulk wash aid dispenser 60 is illustrated in FIGS. 5*a* and 5*b*. This second embodiment is identical to the first except that the second has a hinged cover 61 and hinged mounting posts 64. The hinged cover 61 and the hinged mounting posts 64 are connected at a hinge 66 such that the hinged cover 61 is moveable between an open fill position, shown in FIG. 5*a*, and a closed use position, shown in FIG. 5*b*. Furthermore, the hinged cover 61 has an inwardly extending shoulder 63 and the hinged mounting posts 64 have an outwardly extending shoulder 65 that frictionally engage and disengage in a manner similar to the corresponding components 43, 45 of the first embodiment.

Figure 6A:
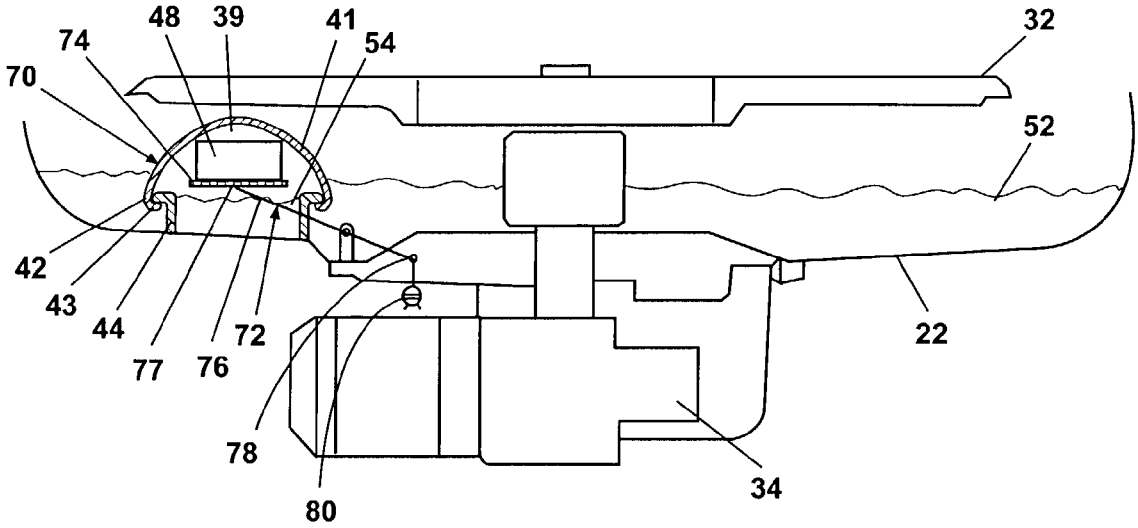
FIG. 6*a* is a schematic view of a second embodiment of the bulk wash aid dispenser having a moveable support for moving the bulk wash aid supply from a neutral position within the cover to an active position wherein the bulk wash aid supply is exposed to liquid in the wash tub to erode or dissolve an individual charge of wash aid, with the moveable support shown in the neutral position.
Figure 6B:
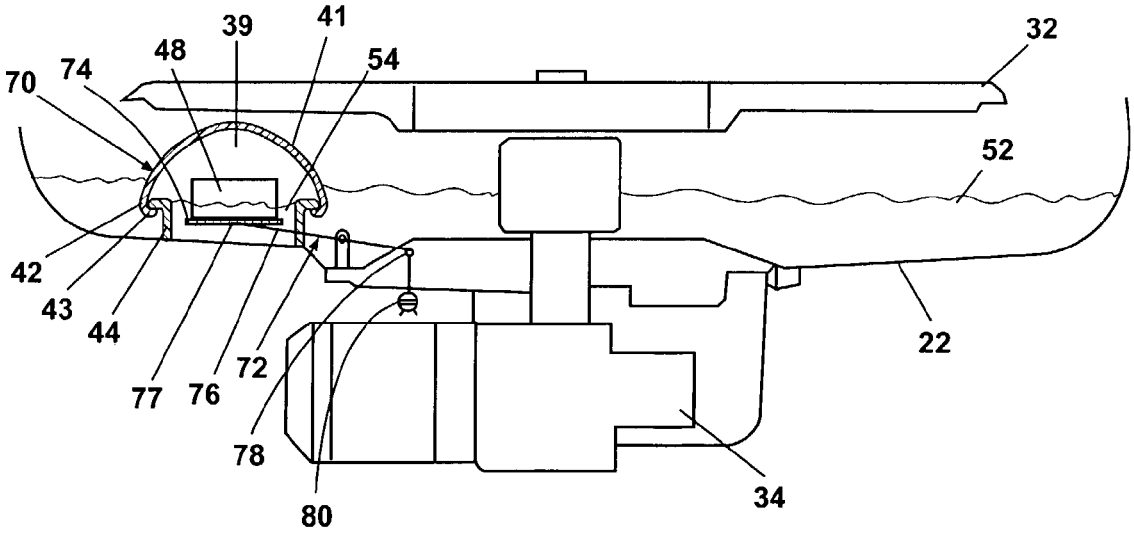
FIG. 6*b* is identical to FIG. 6*a* except that the movable support is shown in the active position.

Referring now to FIGS. 6*a* and 6*b*, a third embodiment of a bulk wash aid dispenser 70, which is identical to the first embodiment except for the manner in which the bulk wash aid is metered. In the third embodiment, a wash aid meter in the form of a moveable support 72 and a height adjustment mechanism 80 is provided for dipping or dunking the bulk wash aid supply 48 into the liquid accumulating in the bottom of the tub 16. The moveable support 72 comprises a cradle 74 for supporting the bulk wash aid supply 48 beneath the cover 41 and an arm 72 connected to the cradle 74 at a first end 77 and to the height adjustment mechanism 80 at a second end 78 and pivotally mounted to the bottom wall 22 of the tub 16. Alternately, the arm 72 could be pivotally mounted to the cover 41 or other appropriate component of the bulk wash aid dispenser 70. The cover 41 and support posts 44 in FIG. 6*a* and 6*b* are of the snap-fit type described in the first embodiment without the attached support 46; however, the hinge cover 61 and hinge support posts 64 of the second embodiment without the attached support 46 are also acceptable for use with the moveable support 72 wash aid meter of this third embodiment.

In operation, the moveable support 72 activates when a dishwashing cycle requires an individual charge of wash aid. Initially, the moveable support 72 is located in a neutral position, shown in FIG. 6*a*, wherein the bulk wash aid supply 48 is positioned in the protective air pocket 39. When activated, the moveable support 72 meters an individual charge of wash aid by pivotally moving the cradle 74 and the arm 76 via the height adjustment mechanism 80 from the neutral position to an active position, shown in FIG. 6*b*, below the lower peripheral edge 42 of the cover 41 to expose the bulk wash aid supply 48 carried by the moveable support 72 to liquid accumulating in the bottom of the wash chamber 26 such that a sufficient amount of wash aid erodes or dissolves from the bulk wash aid supply 48 to form the individual charge of wash aid. After the accurate individual charge of wash aid is dispensed into the liquid recirculation system 28, the moveable support 72 returns the bulk wash aid supply 48 to the protective neutral position by pivotal movement of the cradle 74 and the arm 76 via the height adjustment mechanism 80. The dispensing process can be a single event or can occur at multiple intervals depending on the dishwashing cycle requirements.

The current invention presents several advantages over the prior art. The bulk wash aid dispensers described herein are able to accurately provide the correct amount of wash aid for various types of dishwashing cycles. Moreover, more than one dispenser can be used in the same household dishwasher to provide the additional advantage of dispensing accurate predetermined mixes of different types of wash aids at the same time. Furthermore, the current invention has the ability to selectively dispense charges of wash aids such that undesired constant release of wash aid into the liquid is prevented. The invention also protects the bulk wash aid supply from both the accumulating liquid and the recirculating liquid.

While the invention has been specifically described in connection with certain specific embodiments thereof, it is to be understood that this is by way of illustration and not of limitation, and the scope of the appended claims should be construed as broadly as the prior art will permit.

What is claimed is:

1. A household dishwasher, comprising:

a housing defining an interior chamber and having an open face providing access to the interior chamber;

a door moveably mounted to the housing for movement between a closed position where the door closes the open face to block access to the interior chamber and an open position where the door is remote from the open face to permit access to the interior chamber;

a tub located within the interior chamber and comprising spaced side walls, a top wall connecting upper edges of the spaced side walls, a bottom wall connecting lower edges of the spaced side walls, and a rear wall connecting rear edges of the spaced side walls to form an open-face wash chamber with an open face that is coincident with the open face of the interior chamber;

a liquid recirculation system for recirculating liquid throughout the wash chamber;

a bulk wash aid dispenser configured to supply an individual charge of wash aid for multiple cycles of the dishwasher is located within the wash chamber and comprising a wash aid meter that dispenses an individual charge of wash aid from a bulk wash aid supply having multiple individual charges of wash aid, the wash aid meter having a spray nozzle that directs a spray of fluid onto the bulk wash aid supply to erode or dissolve a sufficient amount of wash aid from the bulk wash aid supply to form the individual charge of wash aid; and an imperforate cover removably coupled to the bottom wall and sized to overlie and receive the bulk wash aid supply, the cover configured to prevent the recirculated liquid from directly contacting the bulk wash aid supply.

2. The household dishwasher according to claim 1, wherein the cover has a lower peripheral edge defining an open bottom.

3. The household dishwasher according to claim 2, wherein the spray nozzle is positioned beneath the bulk wash aid supply to direct a spray of fluid through the open bottom of the cover and onto the bulk wash aid supply.

4. The household dishwasher according to claim 2, wherein the lower peripheral edge extends below the bulk wash aid supply when the bulk wash aid supply is received within the cover to form an air pocket around the bulk wash aid supply to prevent liquid that accumulates in the bottom of the wash chamber from contacting the bulk wash aid supply when the level of the accumulating liquid is above the peripheral edge of the cover.

5. The household dishwasher according to claim 1, wherein the cover has the shape of a dome.

6. The household dishwasher according to claim 1, wherein the cover is removeably coupled to the bottom wall.

7. The household dishwasher according to claim 1, wherein the bulk wash aid dispenser further comprises a support for holding the bulk wash aid supply and the support is carried by the cover.

8. The household dishwasher according to claim 7, wherein the support is removeably mounted to the cover.

9. The household dishwasher according to claim 1, wherein the cover has a lower peripheral edge that extends below the bulk wash aid supply when the bulk wash aid supply is received within the cover to form an air pocket around the bulk wash aid supply to prevent liquid that accumulates in the bottom of the wash chamber from contacting the bulk wash aid supply when the level of the accumulating liquid rises above the peripheral edge.

10. The household dishwasher according to claim 9, wherein the cover has the shape of a dome.

11. The household dishwasher according to claim 9, wherein the cover is removeably coupled to the bottom wall.

12. A household dishwasher, comprising:

a tub comprising spaced side walls, a top wall connecting upper edges of the spaced side walls, a bottom wall connecting lower edges of the spaced side walls, and a rear wall connecting rear edges of the spaced side walls to form an open-face wash chamber;

a liquid recirculation system for recirculating liquid throughout the wash chamber;

a bulk wash aid dispenser configured to supply an individual charge of wash aid for multiple cycles of the dishwasher is mounted within the wash chamber and comprising a wash aid meter that dispenses an individual charge of wash aid from a bulk wash aid supply having multiple individual charges, the wash aid meter having a spray nozzle that directs a spray of fluid onto the bulk wash aid supply to erode or dissolve a sufficient amount of wash aid from the bulk wash aid supply to form the individual charge of wash aid; and an imperforate cover sized to overlie and receive the bulk wash aid supply, the cover configured to prevent the recirculated liquid from directly contacting the bulk wash aid supply, wherein the cover is removably coupled to the bottom wall.

13. The household dishwasher according to claim 12, wherein the cover has a lower peripheral edge that extends below the bulk wash aid when the bulk wash aid supply is received within the cover to form an air pocket around the bulk wash aid supply to prevent liquid that accumulates in the bottom of the wash chamber from contacting the bulk wash aid supply when the level of the accumulating liquid rises above the peripheral edge.

14. The household dishwasher according to claim 12, wherein the cover has a dome shape.

15. The household dishwasher according to claim 12, wherein the cover is moveably coupled to the bottom wall, wherein the cover can be moved from a closed use position to an open fill position.

16. The household dishwasher according to claim 12, wherein the cover is removeably coupled to the bottom wall.

17. A household dishwasher, comprising:

a tub comprising spaced side walls, a top wall connecting upper edges of the spaced side walls, a bottom wall connecting lower edges of the spaced side walls, and a rear wall connecting rear edges of the spaced side walls to form an open-face wash chamber;

a liquid recirculation system for recirculating liquid throughout the wash chamber;

a bulk wash aid dispenser located within the wash chamber and comprising a wash aid meter that dispenses an individual charge of wash aid from a bulk wash aid supply having multiple individual charges of wash aid; and an imperforate cover is configured to overlie and receive the bulk wash aid supply to prevent the recirculated liquid from directly contacting the bulk wash aid supply and to form an air pocket around the bulk wash aid supply to prevent liquid accumulating in the bottom of the wash chamber from contacting the bulk wash aid supply.

18. The household dishwasher according to claim 17, wherein the cover has a lower peripheral edge that extends below the bulk wash aid supply when the bulk wash aid supply is received within the cover to form the air pocket around the bulk wash aid supply.

19. The household dishwasher according to claim 18, wherein the wash aid meter comprises a spray nozzle that directs a spray of fluid onto the bulk wash aid supply to erode or dissolve a sufficient amount of wash aid from the bulk wash aid supply to form the individual charge of wash aid.

20. The household dishwasher according to claim 19, wherein the spray nozzle is positioned beneath the bulk wash aid supply to direct a spray of fluid through the open bottom of the cover and onto the bulk wash aid supply.

21. The household dishwasher according to claim 17, wherein the bulk wash aid dispenser further comprises a support for holding the bulk wash aid supply and the support is carried by the cover.

22. The household dishwasher according to claim 21, wherein the support is removeably mounted to the cover.

23. The household dishwasher according to claim 21, wherein the support is moveably mounted to the cover for movement between a neutral position in the air pocket to an active position below the lower peripheral edge of the cover to expose the bulk wash aid supply carried by the moveable support to liquid accumulating in the bottom of the wash chamber to erode or dissolve a sufficient amount of wash aid from the bulk wash aid supply to form the individual charge of wash aid.

24. The household dishwasher according to claim 23, wherein the moveable support comprises a cradle for supporting the bulk wash aid supply and an arm connected to the cradle and pivotally mounted to one of the cover and the bottom wall for pivotal movement between a first position where the cradle is in the neutral position and a second position where the cradle is in the active position.

* * * * *